United States Patent [19]

Hisaoka et al.

[11] Patent Number: 4,477,246

[45] Date of Patent: Oct. 16, 1984

[54] SILENCER UNIT

[75] Inventors: Satoshi Hisaoka, Fujinomiya; Takashi Matsuzaka, Fuji; Toshihiko Saito, Yokohama, all of Japan

[73] Assignee: Suzuye and Suzuye, Kawasaki, Japan

[21] Appl. No.: 474,978

[22] Filed: Mar. 14, 1983

[30] Foreign Application Priority Data

Mar. 15, 1982 [JP] Japan ..... 57-40604

[51] Int. Cl.[3] ..... F23D 15/02

[52] U.S. Cl. ..... 431/114; 431/1; 122/24; 181/272

[58] Field of Search ..... 181/232, 233, 238, 239, 181/257, 264, 265, 266, 267, 268, 271, 272, 273; 431/1, 114; 122/24

[56] References Cited

U.S. PATENT DOCUMENTS 2,965,079 12/1960 Collinson ..... 122/24

FOREIGN PATENT DOCUMENTS 2825809 5/1928 Fed. Rep. of Germany ..... 431/1

OTHER PUBLICATIONS

WO81/01456, May 28, 1981, PCT, Olsson et al.

*Primary Examiner*—L. T. Hix
*Assistant Examiner*—Brian W. Brown
*Attorney, Agent, or Firm*—Cushman, Darby & Cushman

[57] ABSTRACT

A silencer unit has charging- and exhaust-side silencers which are integrally formed into a double-cylinder housing. The housing has an outer cylinder and an inner cylinder disposed in the outer cylinder. The charging-side silencer is connected to an air charging pipe of a pulse combustor to attenuate noise generated from the charging side of the combustor. The exhaust-side silencer is connected to an exhaust pipe of the combustor to attenuate noise generated from the exhausing side of the combustor. The charging-side silencer has a first low-frequency sound arresting chamber defined in the inner cylinder and a first high-frequency sound arresting chamber defined between the inner and outer cylinders. The exhaust-side silencer has a second low-frequency sound arresting chamber defined in the inner cylinder and a second high-frequency sound arresting chamber defined between the inner and outer cylinders.

8 Claims, 2 Drawing Figures

SILENCER UNIT

BACKGROUND OF THE INVENTION

This invention relates to a silencer unit, and more specifically, to a silencer unit for a pulse combustor adapted to arrest noise produced by combustion in the pulse combustor.

Hot water supply systems and other systems using a pulse combustor as a heat source are provided with silencers for attenuating noise generated from the pulse combustor during combustion. More specifically, one such system has two silencers: one for attenuating noise from the charging side of the pulse combustor and the other for noise from the exhaust side. The noise generated from the combustor may vary with the oscillation frequency of the pulse combustor, including high- and low-frequency components. In particular, the low-frequency components are liable to leak through the walls of the silencers. It is therefore harder to attenuate the low-frequency components than the high-frequency components. Thus, the walls of conventional silencers are made quite thick to provide improved sound-arresting effects. As a result, however, the silencers are heavy, and their material costs, and hence, manufacturing costs increase substantially. Moreover, the use of the two individual silencers on the charging and exhaust sides requires a wide setting space.

SUMMARY OF THE INVENTION

This invention is contrived in consideration of these circumstances, and is intended to provide a silencer unit enjoying compact design and capable of effectively arresting sound without using a thick wall.

According to one aspect of the invention, there is provided a silencer unit which comprises a housing including an outer cylinder, an inner cylinder disposed in the outer cylinder, a first end plate closing one end of the outer cylinder, and a second end plate closing the other end of the outer cylinder. The silencer unit further comprises first and second low-frequency sound arresting chambers defined in the inner cylinder and first and second high-frequency sound arresting chambers defined between the outer and inner cylinders. The first low- and high-frequency sound arresting chambers communicate with each other and with an air charging pipe of a pulse combustor to form a charging-side silencer for attenuating noise generated from the charging side of the pulse combustor. The second low- and high-frequency sound arresting chambers connect with each other and with an exhaust pipe of the pulse combustor to form an exhaust-side silencer for attenuating noise generated from the exhaust side of the pulse combustor.

According to this silencer unit, the charging- and exhaust-side silencers are integrally formed into a double-cylinder housing. Accordingly, the silencer unit of the invention can be made more compact as a whole than prior art silencer units that are provided with two separate silencers for the charging and exhaust noises. Thus, the setting space can be reduced. Moreover, the first and second low-frequency sound arresting chambers are located in the inner cylinder, that is, inside the first and second high-frequency sound arresting chambers. Even if the low-frequency components of the noise from the pulse combustor leaks out of the first and second low-frequency sound arresting chambers, therefore, they can be prevented from leaking outside by the outer cylinder. Thus, the noise from the pulse combustor can be securely arrested without thickening the walls of the inner and outer cylinders.

DETAILED DESCRIPTION OF THE PREFERRED EMBODIMENT

There will now be described in detail an embodiment of this invention with reference to the accompanying drawings.

Figure 1:
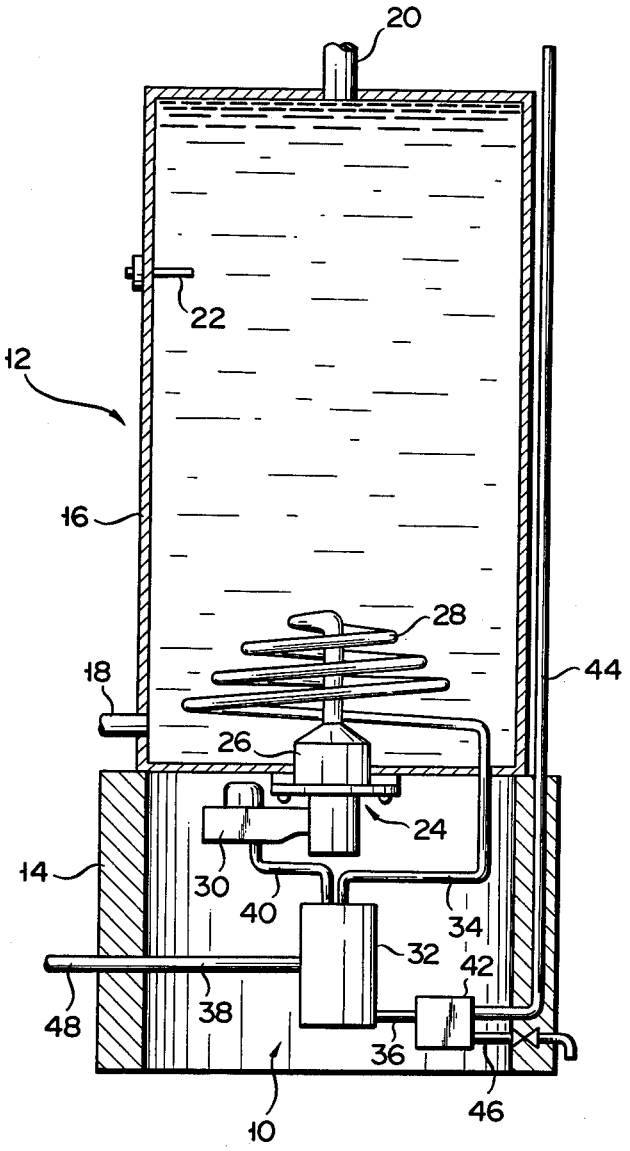
FIG. 1 is a vertical sectional view of a hot water supply system with a silencer unit according to an embodiment of this invention.

FIG. 1 shows a hot water supply system 12 provided with a silencer unit 10 according to an embodiment of the invention. The hot water supply system 12 comprises a base 14 and a cylinder hot water tank 16 supported on the base 14. The base 14 is a cylinder formed of a sound absorbent material. The hot water tank 16 includes a feed water pipe 18, a hot water pipe 20, and a thermostat 22. The hot water supply system 12 is provided with a pulse combustor 24. The pulse combustor 24 comprises a burner body 26 fixed to the bottom wall of the hot water tank 16 and having a combustion chamber (not shown) therein, an exhaust pipe 28 extending from the burner body 26 into the hot water tank 16, and an air charging pipe 30 opening into the combustion chamber. The extended end portion of the exhaust pipe 28 penetrates the bottom wall of the hot water tank 16 to project into the base 14. The air charging pipe 30 is located inside the base 14 and attached to the burner body 26.

The silencer unit 10 is disposed in the base 14 and connected to the air charging pipe 30 and the exhaust pipe 28. The silencer unit 10 serves to attenuate noise generated from the pulse combustor 24. The silencer unit 10 comprises a housing 32, an exhaust gas inlet pipe 34, an exhaust gas outlet pipe 36, a charge inlet pipe 38, and a charge outlet pipe 40, all these pipes extending from the housing 32. The exhaust gas inlet pipe 34 is connected to the exhaust pipe 28, while the exhaust gas outlet pipe 36 is connected to an exhaust tube 44 through a drain reservoir 42. The exhaust tube 44 penetrates the base 14 to project upward. A drain pipe 46 extends from the drain reservoir 42 and penetrates the base 14 to project outward therefrom. The charge outlet pipe 40 opens into the air charging pipe 30, while the charge inlet pipe 38 is connected to an intake pipe 48. The intake pipe 48 penetrates the base 14 to project outward therefrom.

Figure 2:
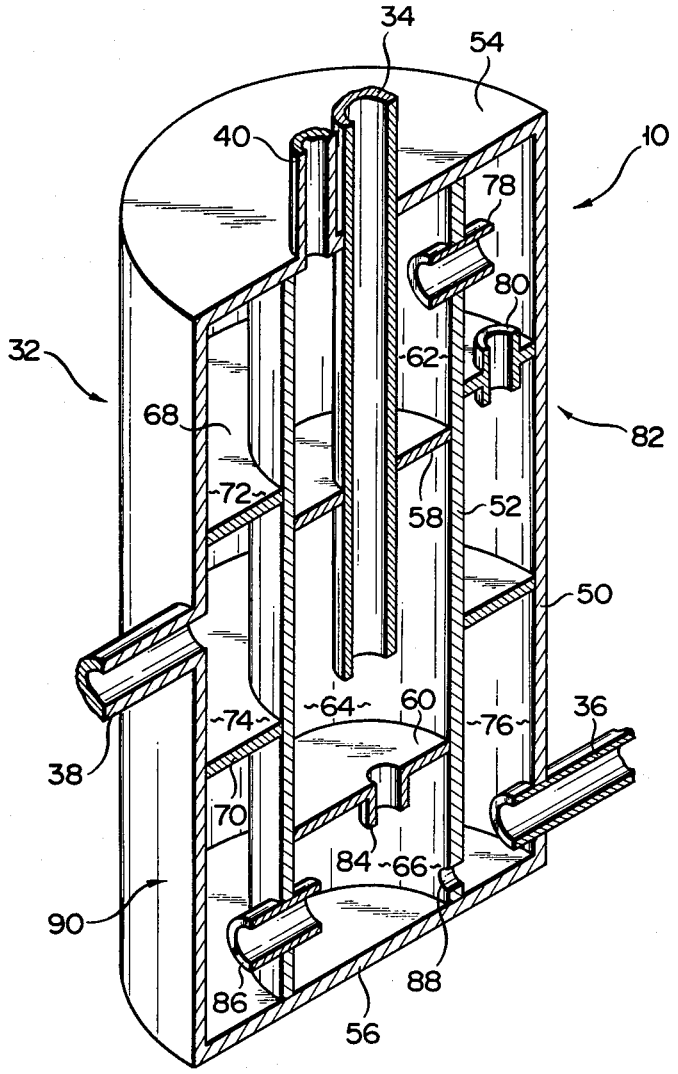
FIG. 2 is a vertical sectional view of the silencer unit.

More specifically, the housing 32 includes an outer cylinder 50 and an inner cylinder 52 therein, as shown in FIG. 2. The outer and inner cylinders 50 and 52 are coaxial and have substantially the same axial length. The upper ends of the outer and inner cylinders 50 and 52 are closed by a first end plate or top plate 54, while their lower ends are closed by a second end plate or bottom plate 56. First and second partition plates 58 and 60 are fixedly arranged in the inner cylinder 52, spaced apart from and facing each other. A first low-frequency sound arresting chamber 62 is defined in the inner cylinder 52 by the top plate 54, the first partition plate 58, and the inner peripheral surface of the inner cylinder 52. A second low-frequency sound arresting chamber 64 is defined in the inner cylinder 52 by the first and second partition plates 58 and 60 and the inner peripheral surface of the inner cylinder 52. Also, a fourth high-frequency sound arresting chamber 66 is defined in the inner cylinder 52 by the second partition plate 60, the bottom plate 56, and the inner peripheral surface of the inner cylinder 52.

Annular third and fourth partition plates 68 and 70 are fixedly arranged between the outer and inner cylinders 50 and 52, spaced apart from and facing each other. A first high-frequency sound arresting chamber 72 is defined by the top plate 54, the third partition plate 68, the inner peripheral surface of the outer cylinder 50, and the outer peripheral surface of the inner cylinder 52. A third high-frequency sound arresting chamber 74 is defined by the third and fourth partition plates 68 and 70, the inner peripheral surface of the outer cylinder 50, and the outer peripheral surface of the inner cylinder 52. Also, a second high-frequency sound arresting chamber 76 is defined by the fourth partition plate 70, the bottom plate 56, the inner peripheral surface of the outer cylinder 50, and the outer peripheral surface of the inner cylinder 52. The third high-frequency sound arresting chamber 74 is located outside the second low-frequency sound arresting chamber 64 to overlap the same radially. The second low-frequency sound arresting chamber 64 is located substantially in the center of the housing 32, surrounded by the first to fourth high-frequency sound arresting chambers 72, 76, 74 and 66 and the first low-frequency sound arresting chamber 62.

The first low-frequency sound arresting chamber 62 and the first high-frequency sound arresting chamber 72 communicate with each other by means of a first charge choke tube 78 attached to the inner cylinder 52. The third partition plate 68 is fitted with a second charge chock tube 80, whereby the first and third high-frequency sound arresting chambers 72 and 74 are communicated. The charge inlet pipe 38 is attached to the outer cylinder 50, and opens into the third high-frequency sound arresting chamber 74. The charge outlet pipe 40 is attached to the top plate 54, and opens into the first low-frequency sound arresting chamber 62. The first low-frequency sound arresting chamber 62 and the first and third high-frequency sound arresting chambers 72 and 74 constitute a charging-side silencer 82 for attenuating noise generated from the charging side of the pulse combustor 24.

The second partition plate 60 is provided with a first exhaust gas choke tube 84, whereby the second low-frequency sound arresting chamber 64 and the fourth high-frequency sound arresting chamber 66 are communicated. The second and fourth high-frequency sound arresting chambers 76 and 66 communicate with each other by means of a second exhaust gas choke tube 86 attached to the inner cylinder 52. The exhaust gas inlet pipe 34 extends through the top plate 54, the first low-frequency sound arresting chamber 62, and the first partition plate 58 to open into the second low-frequency sound arresting chamber 64. The exhaust gas outlet pipe 36 penetrates the outer cylinder 50 to open into the second high-frequency sound arresting chamber 76. A drain port 88 opening into the second and fourth high-frequency sound arresting chambers 76 and 66 is bored through the inner cylinder 52 near the bottom plate 56. The second low-frequency sound arresting chamber 64 and the second and fourth high-frequency sound arresting chambers 76 and 66 constitute an exhaust-side silencer 90 for attenuating noise generated from the exhaust side of the pulse combustor 24.

The operation of the silencer unit 10 constructed in this manner will now be described.

First, combustion gas produced by the pulse combustor 24, along with the exhaust-side noise, is led into the second low-frequency sound arresting chamber 64 of the exhaust-side silencer 90 through the exhaust pipe 28 and the exhaust gas inlet pipe 34. The low-frequency components of the exhaust-side noise are attenuated in the second low-frequency sound arresting chamber 64. Then, the combustion gas, along with the exhaust-side noise, is delivered to the exhaust gas outlet pipe 36 via the first exhaust gas choke tube 84, the fourth high-frequency sound arresting chamber 66, the second exhaust gas choke tube 86, and the second high-frequency sound arresting chamber 76. Meanwhile, the high-frequency components of the exhaust-side noise are attenuated in the second and fourth high-frequency sound arresting chambers 76 and 66. Then, the combustion gas is discharged through the drain reservoir 42 and the exhaust tube 44. Thus, the noise generated from the exhaust side of the pulse combustor 24 is attenuated by the exhaust-side silencer 90.

The charging-side noise produced by the combustion in the pulse combustor 24 is led into the first low-frequency sound arresting chamber 62 of the charging-side silencer 82 through the air charging pipe 30 and the charge outlet tube 40. The low-frequency components of the charging side noise are attenuated in the first low-frequency sound arresting chamber 62. Then, the charging-side noise is delivered to the charge inlet pipe 38 via the first charge choke tube 78, the first high-frequency sound arresting chamber 72, the second charge choke tube 80, and the third high-frequency sound arresting chamber 74. Meanwhile, the high-frequency components of the charging-side noise are attenuated in the first and third high-frequency sound arresting chambers 72 and 74. Thus, the noise generated from the charging side of the pulse combustor 24 is attenuated by the charging-side silencer 82. Hereupon, the level of the exhaust-side noise is generally higher than that of the charging-side noise. Therefore, the low-frequency components of the exhaust-side noise are liable to leak outward from the second low-frequency sound arresting chamber 64. According to this embodiment, however, the second low-frequency sound arresting chamber 64 is located substantially in the center of the housing 32, and is surrounded by the first to fourth high-frequency sound arresting chambers 72, 74, 66 and 76 and the first low-frequency sound arresting chamber 62. Even if the low-frequency components of the noise leak from the second low-frequency sound arresting chamber 64, therefore, they can be prevented from leaking to the outside by the top and bottom plates 54 and 56 and the outer cylinder 50.

In the meantime, the outside air is sucked into the charging-side silencer 90 through the intake pipe 48 and the charge inlet pipe 38 by a negative pressure produced in the combustion chamber (not shown) of the pulse combustor 24. This outside air is led into the first low-frequency sound arresting chamber 62 through the third high-frequency sound arresting chamber 74, the second charge choke tube 80, the first high-frequency sound arresting chamber 72, and the first charge choke tube 78. While passing through the third high-frequency sound arresting chamber 74, the air is subjected to heat from the combustion gas in the second low-frequency sound arresting chamber 64 through the medium of the inner cylinder 52. While passing through the first low-frequency sound arresting chamber 62, moreover, the air is additionally heated by heat from the combustion gas flowing through the exhaust gas inlet pipe 34 through the medium of the wall of the pipe 34. The heated air is led into the combustion chamber (not shown) of the pulse combustor 24 through the charge outlet pipe 30.

Condensed water produced in the exhaust pipe 28 of the pulse combustor 24 is led to the exhaust gas outlet pipe 36 via the exhaust gas inlet pipe 34, the first exhaust gas choke tube 84, and the drain port 88, and is then discharged through the drain reservoir 42 and the drain pipe 46.

The silencer unit 10 of the aforementioned construction has the following advantages.

The charging- and exhaust-side silencers 82 and 90 are integrally formed into a double-cylinder structure. Accordingly, the silencer unit 10 of the invention can be made more compact as a whole than the prior art silencer units that are provided with two separate silencers for the charging and exhaust noises. Thus, the setting space can be reduced. Moreover, the first and second low-frequency sound arresting chambers 62 and 64 for attenuating the low-frequency components of the noise generated from the pulse combustor 24 are located in the inner cylinder 52, that is, inside the first to third high-frequency sound arresting chambers 72, 76 and 74. Even if the low-frequency components leak out of the low-frequency sound arresting chambers 62 and 64, therefore, they can be prevented from leaking outside by the outer cylinder 50. Thus, the noise can be securely arrested without making the walls of the inner and outer cylinders 52 and 50 unduly thick. The use of thin-walled cylinders leads to a reduction in both manufacturing cost and weight of the silencer unit. The second low-frequency sound arresting chamber 64, in particular, is located substantially in the center of the housing 32, surrounded by the first to fourth high-frequency sound arresting chambers 72, 76, 74 and 66 and the first low-frequency sound arresting chamber 62. It is therefore possible to effectively silence even a relatively large amount of noise generated from the exhaust side of the pulse combustor 24.

Furthermore, the exhaust gas inlet pipe 34 extends through the first low-frequency sound arresting chamber 62, and the third high-frequency sound arresting chamber 74 is located radially outside the second low-frequency sound arresting chamber 64. Accordingly, the heat of combustion gas passing through the exhaust gas inlet pipe 34 and the first low-frequency sound arresting chamber 64 is transmitted to the outside air flowing through the first low-frequency sound arresting chamber 62 and the third high-frequency sound arresting chamber 74. As a result, the outside air to be fed into the pulse combustor 24 is heated while it passed through the charging-side silencer 82. Thus, the pulse combustor 24 can enjoy improved combustion efficiency.

Although an illustrative embodiment of this invention has been described in detail herein, it is to be understood that the invention is not limited to this embodiment, and that various changes and modifications may be effected therein by one skilled in the art without departing from the scope or spirit of the invention. In the above embodiment, each of the charging- and exhaust-side silencers has two high-frequency sound arresting chambers. However, the number of high-frequency sound arresting chambers may be varied as required. It is only necessary that the low-frequency sound arresting chambers be located inside the high-frequency sound arresting chambers.

What we claim is:

1. A silencer unit which is connected to a pulse combustor having an air charging pipe and an exhaust pipe and attenuates noise generated from the pulse combustor, comprising:

a housing including an outer cylinder, an inner cylinder disposed in the outer cylinder, a first end plate closing one end of the outer cylinder, and a second end plate closing the other end of the outer cylinder;

first and second low-frequency sound arresting chambers defined individually in the inner cylinder for attenuating the low-frequency components of the noise generated from the pulse combustor; and first and second high-frequency sound arresting chambers defined individually between the outer and inner cylinders for attenuating the high-frequency components of the noise generated from the pulse combustor, the first low- and high-frequency sound arresting chambers communicating with each other and with the air charging pipe to form a charging-side silencer for attenuating noise generated from the charging side of the pulse combustor, and the second low- and high-frequency sound arresting chambers communicating with each other and with the exhaust pipe to form an exhaust-side silencer for attenuating noise generated from the exhaust side of the pulse combustor.

2. The silencer unit according to claim 1, wherein said inner cylinder is substantially equal in axial length to the outer cylinder and coaxial with the outer cylinder, one end of the inner cylinder is closed by the first end plate, and the other end of the inner cylinder is closed by the second end plate.

3. The silencer unit according to claim 2, wherein said housing includes first and second partition plates spaced apart from and facing each other in the inner cylinder to divide the space in the inner cylinder, and annular third and fourth partition plates spaced apart from and facing each other between the outer and inner cylinders to divide the space between the outer and inner cylinders, the first low-frequency sound arresting chamber is defined by the first end plate, the first partition plate, and the inner cylinder, the second low-frequency sound arresting chamber is defined by the first and second partition plates and the inner cylinder, the first high-frequency sound arresting chamber is defined by the first end plate, the third partition plate, and the inner and outer cylinders, the second high-frequency sound arresting chamber is defined by the second end plate, the fourth partition plate, and the inner and outer cylinders, the charging-side silencer includes a third high-frequency sound arresting chamber for attenuating the high-frequency components of the noise generated from the charging side of the pulse combustor which is defined by the third and fourth partition plates and the inner and outer cylinders and is connected with the first high-frequency sound arresting chamber, and the exhaust-side silencer includes a fourth high-frequency sound arresting chamber for attenuating the high-frequency components of the noise generated from the exhaust side of the pulse combustor which is defined by the second end plate, the second partition plate, and the inner cylinder and is connected with the second low- and high-frequency sound arresting chambers.

4. The silencer unit according to claim 3, wherein said inner cylinder has a first charge choke tube connecting the first low- and high-frequency sound arresting chambers, and a second exhaust gas choke tube connecting the second and fourth high-frequency sound arresting chambers, the second partition plate has a first exhaust gas choke tube connecting the second low-frequency sound arresting chamber and the fourth high-frequency sound arresting chamber, and the third partition plate has a second charge choke tube connecting the first and third high-frequency sound arresting chambers.

5. The silencer unit according to claim 4, wherein said housing has a charge inlet pipe connecting with the charging-side silencer to lead the outside air into the charging-side silencer, a charge outlet pipe connecting with the charging-side silencer and the air charging pipe to lead the outside air having passed through the charging-side silencer to the air charging pipe, an exhaust gas inlet pipe connecting with the exhaust pipe and the exhaust-side silencer to lead combustion gas generated from the pulse combustor into the exhaust-side silencer, and an exhaust gas outlet pipe connecting with the exhaust-side silencer to lead the combustion gas having passed through the exhaust-side silencer out of the same.

6. The silencer unit according to claim 5, wherein said charge inlet pipe is attached to the outer cylinder to open into the third high-frequency sound arresting chamber, the charge outlet pipe is attached to the first end plate to open into the first low-frequency sound arresting chamber, the exhaust gas inlet pipe extends through the first end plate, the first low-frequency sound arresting chamber, and the first partition plate to open into the second low-frequency sound arresting chamber, and the exhaust gas outlet pipe is attached to the outer cylinder to open into the second high-frequency sound arresting chamber.

7. The silencer unit according to claim 6, wherein said exhaust-side silencer has a drain port formed in the inner cylinder for discharging condensed water produced in the exhaust pipe, the drain port adjoining the second end plate and opening into the second and fourth high-frequency sound arresting chambers, and the exhaust gas outlet pipe opens into the second high-frequency sound arresting chamber to face the drain port.

8. The silencer unit according to claim 4, wherein said third high-frequency sound arresting chamber is located radially outside the second low-frequency sound arresting chamber.

* * * * *